United States Patent [19]

Hsieh

[11] 4,304,417

[45] Dec. 8, 1981

[54] ADJUSTABLE PLASTIC ROLLER SKATE

[75] Inventor: Even Hsieh, Taipei, Taiwan

[73] Assignee: Red Stone Enterprise Co., Ltd., Taipai, Taiwan

[21] Appl. No.: 98,336

[22] Filed: Nov. 27, 1979

[51] Int. Cl.[3] ..... A63C 17/02

[52] U.S. Cl. ..... 280/11.26; 280/11.19

[58] Field of Search ..... 280/11.26, 11.19, 11.28, 280/11.27, 87.04 A, 11.3

[56] References Cited

U.S. PATENT DOCUMENTS

| | | | |
|---|---|---|---|
| 2,719,723 | 10/1955 | Ware | 280/11.28 X |
| 2,927,798 | 3/1960 | Jones et al. | 280/11.26 |
| 3,202,435 | 8/1965 | Goodman | 280/11.26 |
| 3,953,041 | 4/1976 | Buss | 280/11.26 |
| 4,128,254 | 12/1978 | Powell | 280/87.04 A |

FOREIGN PATENT DOCUMENTS

| | | | |
|---|---|---|---|
| 1318039 | 5/1973 | United Kingdom | 280/11.19 |

*Primary Examiner*—Joseph F. Peters, Jr.
*Assistant Examiner*—Milton L. Smith
*Attorney, Agent, or Firm*—Weingram & Klauber

[57] ABSTRACT

A size-adjustable high performance slip-on plastic roller skate has an injection-molded sole support piece in the form of separable front and rear sections respectively provided with wheel assemblies secured thereto. The sections are slidingly interfitted for movement toward and away from each other to vary the longitudinal extension of said sole support piece and can be locked at a plurality of the adjusted interfitted positions to enable accommodation of a plurality of shoe sizes. A metal reinforcing frame member is molded into one of said front and rear sections and extends within at least the interfitted portion of said sections, to bridge said portion at all size-adjusted positions, whereby to provide rigidity for the skate, enabling use of same in high performance applications.

4 Claims, 7 Drawing Figures

ADJUSTABLE PLASTIC ROLLER SKATE

BACKGROUND OF INVENTION

This invention relates generally to roller skates, and more specifically relates to adjustable roller skates of the so-called "slip-on" type, which are nonetheless adapted for high performance use.

Roller skates of all types and degree of refinement have been in use for many decades. Consideration of the prior art constructions applicable thereto, will establish that by and large roller skates have been considered as either a low-cost, toy-like device for use primarily by young children; or else have taken the form of much more sophisticated apparatus, intended for use by highly skilled individuals, as, for example, in roller rink use or in sports competition and the like. The latter type of device has generally included a boot, to which is secured in permanent fashion a sole plate, which in turn carries the roller assemblies.

Recently, a great revival has occurred in interest in roller skates, with the use of same not being confined to roller rinks, even where comparatively sophisticated boot-type roller skates are involved. A number of considerations are pertinent from a technical viewpoint for the new interest thus developed, including the now widespread use of polyurethane or similarly comprised wheels, which lend themselves to excellent use both in indoor facilities, as well as upon sidewalks, street surfaces or the like.

One type of prior art roller skate, primarily considered in the past as a toy-like device, has been intended for use with conventional shoes. These roller skates, sometimes referred to as "slip-on," or adjustable skates, conventionally include a sole support plate or piece, to the underside of which are secured pairs of roller wheels, i.e. one at either end of the sole support piece. The support piece, further, is normally constructed so as to enable variation in the longitudinal extension of same, to thereby enable the skate to accommodate a variety of shoe sizes.

The adjustable slip-on skate of the above type, in addition to having in the past included low cost metal wheels or the like, thus rendering the skate of limited use in high performance applications (especially on street surfaces) usually had its sole support plate constructed of a metal such as steel, in order to provide the necessary strength and rigidity to enable reasonably long-term use.

In the above connection, it has been recognized that a number of significant advantages would reside in a plastic construction for the slip-on type of skate. Aside from relatively enormous cost savings in production of same, such a skate would be very useful in absorbing shocks and the like, especially where the skate is worn for outdoor (hard surface) use. However, consideration of prior roller skate structures based upon plastics, will establish that such devices have indeed been considered mere toys, and not acceptable for high performance applications. Such devices thus lacked sufficient mechanical strength to enable high performance use. Among other things, they lacked structural features as would enable same to be subjected to sustained high speed use, especially under conditions as would impose severe shock on the structure.

In accordance with the foregoing, it may be regarded as an object of the present invention, to provide a size-adjustable high performance slip-on plastic roller skate, which is of great structural strength and integrity, and is capable of absorbing substantial shock during use of same, without impairing the structure, and without substantial discomfort to the user.

SUMMARY OF INVENTION

Now in accordance with the present invention, the foregoing object, and others as will become apparent in the course of the ensuing specification, are achieved in a high performance, slip-on plastic roller skate, which comprises an injection molded sole support piece, comprising separable front and rear sections respectively provided with wheel assemblies secured thereto. The said sections are slidingly interfitted to enable movement toward and away from each other to vary the longitudinal extension of the sole support piece. Means are provided for locking the interfitted sections at a plurality of the adjusted interfitted positions, to enable accommodation of a plurality of shoe sizes. A metal reinforcing frame member is molded into one of the front and rear sections, and extends within at least the interfitted portion of such sections, to thereby bridge said portion at all size adjusted positions, in consequence of which rigidity is provided for the skate, enabling use of same in high performance applications.

In a preferred construction in accordance with the invention, the rear sole support piece section may include a tongue which extends longitudinally and is receivable in a longitudinally extending opening in the front sole support piece section. The reinforcing frame member in this embodiment may comprise a U-channeled shaped member, about which the said tongue is molded during the injection molding process. A fastener means may pass through the rearward most portion of the U-channel member to further anchor same at the heel end of the rear sole support section. The said fastener may also serve to partially secure the rear roller wheel assembly.

The U-channel member in the above embodiment is further, preferably provided with a series of openings along the length of same in the flat bottom of the U. These openings align with openings in the plastic material molded about the U-channel member. By aligning one of the said openings with an opening in the top and bottom walls abounding the receiving opening in the forward sole support section, and thereupon passing a bolt through same and securing the bolt with a wing nut or the like, one may lock the sole piece at various extended positions, and thereby control the length of the skate.

Each of the wheel assemblies is secured to its respective sole piece section by fastening means as aforesaid, which preferably include shock absorbing means such as intermediate rubber or other resilient washers. The aforementioned front and rear sole piece sections are preferably injection molded of a high impact, high strength plastic, such as appropriate formulations of polypropylene.

BRIEF DESCRIPTION OF DRAWINGS

The invention is diagrammatically illustrated, by way of example, in the drawings appended hereto, in which.

DESCRIPTION OF PREFERRED EMBODIMENT

Figure 1:
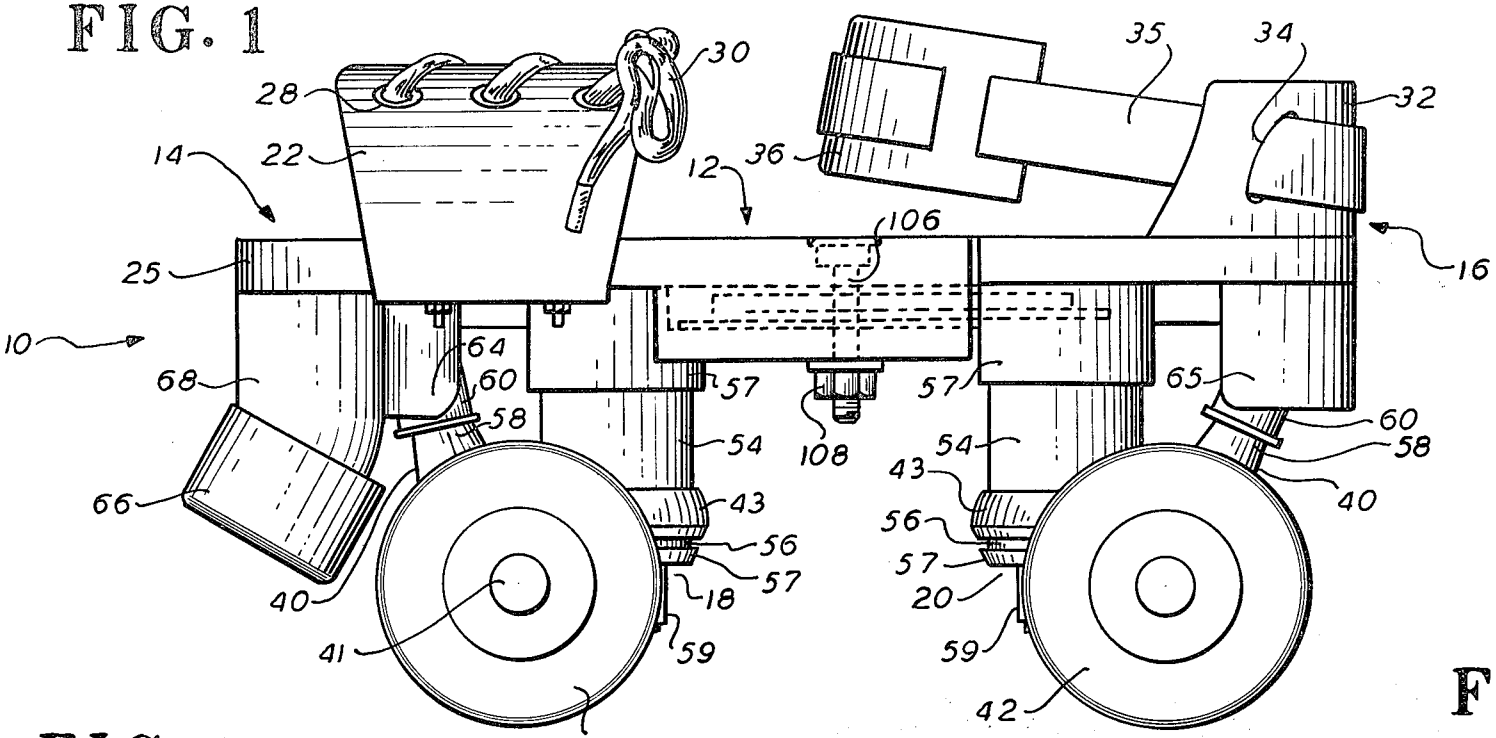
FIG. 1 is a side elevational view of a slip-on plastic roller skate in accordance with the invention, the skate being shown in its most collapsed, i.e. most foreshortened configuration.
Figure 7:
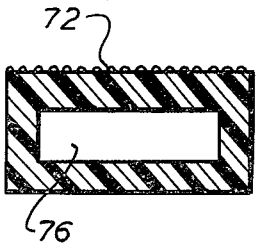
FIG. 7 is a further transverse cross-sectional view, said view being of the receiving slot portion of the present apparatus, and being taken along the line 7—7 of FIG. 3.

In FIG. 1 herein, a side elevational view appears of a size adjustable slip-on plastic roller skate 10, in accordance with the present invention. The skate 10 is, of course, normally part of a pair of such devices. Skate 10, as indicated, is of the slip-on type, i.e. intended for use with normal shoes or the like. FIG. 1 may usefully be considered simultaneously with FIG. 2, in order to better appreciate that the skate 10 generally comprises a plastic injection molded sole support piece 12 which comprises separable front and rear sections 14 and 16. In the view of FIG. 1, sections 14 and 16 are shown in their fully interfitted or internested positions, whereby the sole support piece 12 is in its most foreshortened or collapsed position, i.e. to accommodate the minimum size shoe with which the particular skate 10 may be used.

The forward section 14 has secured thereto a roller wheel assembly 18; the rearward section 16 similarly has a roller wheel assembly 20 secured to same. Front section 14 has a pair of cuffs or toe straps 22 and 24 secured thereto. Each said strap is secured to the top plate 25 of section 14 by fasteners 26 consisting of a threaded member and a small nut. The said straps 22, 24 are comprised of a flexible plastic material such as a PVC-type plastic, and include eyelets 28 through which a cord or lace 30 may be threaded. The said cuffs are arranged in proximity to one another atop the shoe supported by piece 12 and the ends of lace 30 are tied to secure the front end of the skate to the shoe.

In similar fashion, the rear section 16 includes an upwardly directed abutment 32, through openings 34 of which a strap 35 is passed. A restraining ankle pad 36 can then pass about the ankle, and the strap 35 fastened via a buckle arrangement or the like, to again aid in securing the skate 10 to the wearer's shoe, once same is in place atop the support plate 12.

Figure 2:
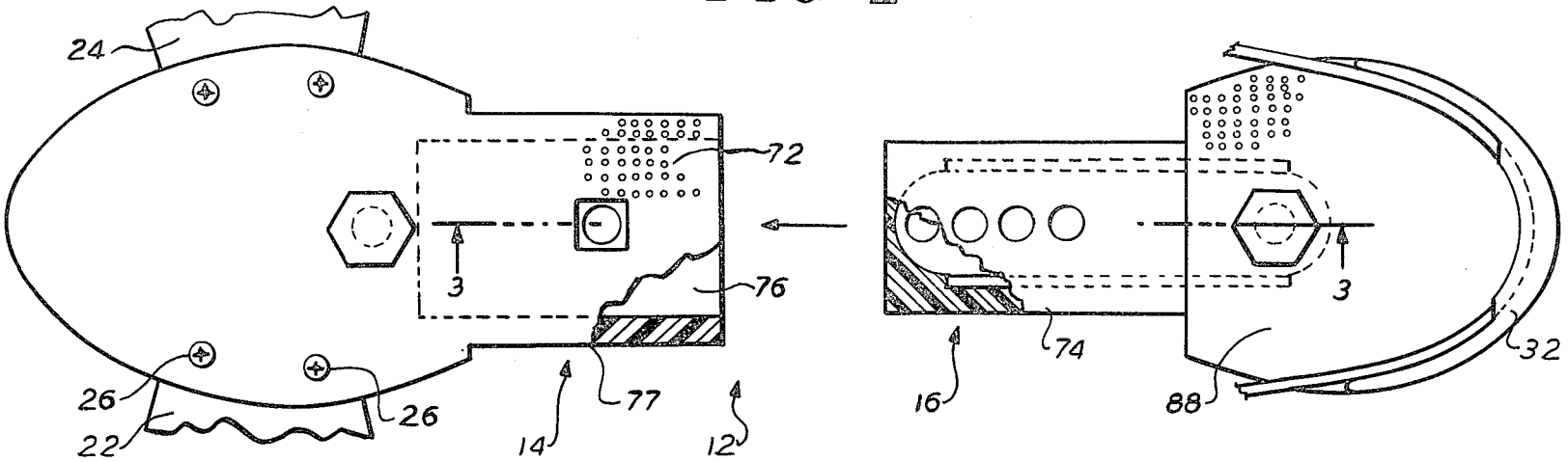
FIG. 2 is a top plan view of the skate of FIG. 1, showing the front and rear sections of the sole support piece in separated relationship.

Each of the roller wheel assemblies 18 and 20 comprises a wheel support bracket 40, which can comprise a metal casting or the like. An axle 41 is mounted in a bore (not shown) which is a transverse portion of bracket 40, and through a suitable bearing structure, wheels 42 are secured to the axle. A portion 43 of the wheel support bracket 40 extends toward the center of the skate, and bolt 44 passes downwardly through this section, and thence is secured (in the case of each wheel assembly 18, 20) to the front or rear sections 14 or 16 by means of nuts 59 secured to the bolts 44 beneath metal cover 57 (FIG. 2). An axially extended cylindrical resilient washer (e.g. of rubber) is provided at 54 and a further lower rubber washer at 56, the latter being retained by the metal cover 57. These rubber washers serve to provide shock absorbing qualities. Thus rubber washer 54 extends between the metal portions 43 of bracket 40 and receiving cups 57 forming part of the molded sections 14 and 16. Dome-shaped nubs 58 extend from the two brackets 40 away from the center of the skate, each being received within a rubber (or other resilient material) cup bushing 60, which is in turn secured in an embossment (not shown) which is molded into the underside of portions 64 and 65 of the respective sections 14 and 16.

Full details of the wheel assemblies 18 and 20, including the bearing structures of same, and the manner in which they may be suitably affixed to the sole support piece, are set forth in my co-pending application Ser. No. 97,157, filed on Nov. 26, 1979 and now abandoned. Such disclosure is hereby incorporated by reference, as if fully set forth at length herein.

With the exception of the wheel assemblies 18 and 20, of the straps 22, 24 and 35 and attendant fastening members, and of a toe-stop structure 66 which is a resilient bumper of rubber or resilient plastic (e.g. polyurethane) fitted about a nose portion 68 at the front section 14, the entire remaining portions of the sections 14 and 16 are unitary, i.e. they each comprise single injection molded pieces. The upward or top facing surface of each of these pieces, is also seen in FIGS. 2 and 3 to be provided with a roughened pebble-like surface 72, in order to increase the frictional engagement with the shoe of the wearer.

Figure 3:
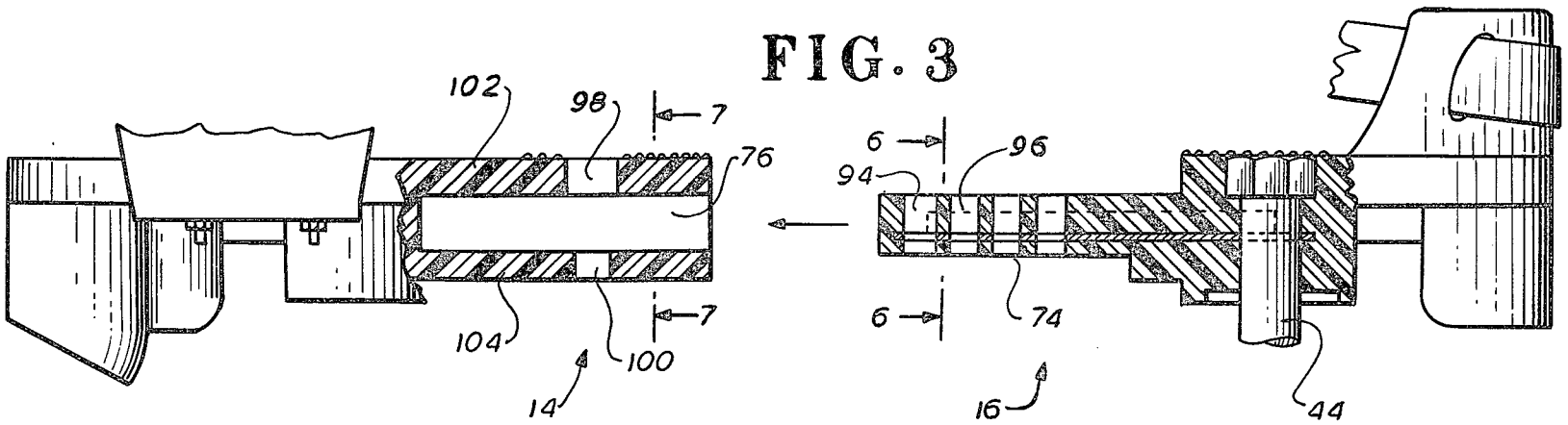
FIG. 3 is a side elevational view, partially sectioned (along the line 3—3 of FIG. 2), of the portions of the skate depicted in FIG. 2.

Referring especially to FIGS. 2 and 3, it is seen that the rearward section 16 is formed with a longitudinally-extending tongue 74, which portion is receivable in an opening 76 which is molded into the rearwardly extending part 77 of section 14. When the tongue 74 is received within opening 76, it is engaged in sliding fashion to enable adjustment in the extension, i.e. the length, of the sole support piece 12.

In accordance with the present invention, a reinforcing frame member 78, comprising a strong metal such as steel, is secured within the rearward section 16 during the injection molding process.

Figure 6:
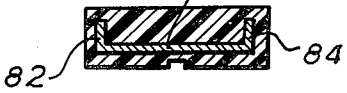
FIG. 6 is a transverse cross-sectional view through the tongue portion of the present device, said view being taken along the line 6—6 of FIG. 3.
Figure 5:
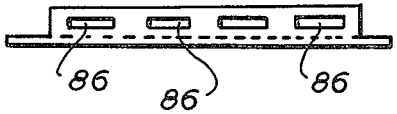
FIG. 5 is a side elevational view of the FIG. 4 member.
Figure 4:
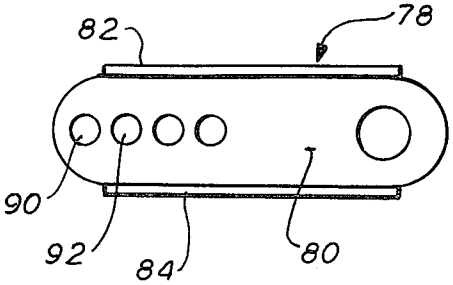
FIG. 4 is a top plan view of the reinforcing frame member utilized in the device of FIGS. 1 through 3.

The reinforcing frame member 78 is seen in top plan and side elevation in FIGS. 4 and 5. As is evident further from the cross-sectional view of FIG. 6, the said member 78 is of U-channel shape, including a broad bottom flat portion 80, and two upwardly directed sides 82 and 84.

These sides 82 and 84, as may be seen from FIG. 5, include a plurality of slotted openings 86, the purpose of which is to permit ready flow of the plastic material, i.e. the polypropylene or the like, during the molding process, to thereby assure that the said member 78 is thoroughly surrounded by plastic at all points thereof, and thoroughly embedded and mechanically maintained in section 16.

The reinforcing member 78 is seen to extend not only through the tongue portion 16, but further, extends rearwardly into the heel 88 of section 16, where it is further secured by the bolt 44 and nut 59 aforementioned.

The reinforcing member 78 is provided with a plurality of spaced openings 90, 92 etc., at successively spaced longitudinal positions on flat 80. Openings 94, 96 etc. (FIG. 3), are formed in the section 16 to align with openings 90, 92, etc. Aligned openings 98 and 100 are similarly present in the upper and lower walls 102 and 104 which abound opening 76 at section 14.

In accordance with the foregoing, the operation of the present device may now be fully appreciated. In particular, in the use the tongue-like portion 74 is received within opening 76, and its interfitted position adjusted until one or another of the openings 90, 92 etc. are aligned with the openings 98, 100, in accordance with the length desired in the sole support piece, i.e. in accordance with total length of the skate desired to support a particular shoe. The fastener, consisting of a bolt 106 and a nut 108 (FIG. 1) has, of course, previously been removed. With the adjustment properly made, the bolt 106 is reinserted and passed through the several aligned openings. The nut 108 is then secured to the far end of the fastener, to lock the skate in its desired extended (or unextended) position. The nut 108 is shown as a simple hexagonal nut. It is also convenient however, to form same as a wing nut in order to enable adjustment of the skate length without use of any auxiliary tools.

Regardless of the adjusted position of the skate structure, it will be seen that the reinforcing frame member 78 substantially bridges the interfitted portion of the sections 14 and 16, to thereby vastly increases the structural strength at this portion of the assembly—which otherwise would be readily subject to undue flexure and consequent breakage.

While the present invention has been particularly set forth in terms of specific embodiments thereof, it will be understood in view of the instant disclosure, that numerous variations upon the invention are now enabled to those skilled in the art, which variations yet reside within the scope of the present teaching. Accordingly, the invention is to be broadly construed, and limited only by the scope and spirit of the claims now appended hereto.

I claim:

1. A size-adjustable, high performance slip-on plastic roller skate, comprising in combination:

an injection molded plastic sole support piece comprising separable front and rear sections; wheel assemblies secured to each said section; said sections being slidingly interfitted for movement toward and away from each other to vary the longitudinal extension of said sole support piece; means for locking said interfitted sections at a plurality of said adjusted interfitted positions, to enable accomodation of a plurality of shoe sizes supportable upon said sole support piece; and a metal reinforcing frame member being molded into one of said front and rear sections and extending at least within the interfitted portion of said sections, to bridge said interfitted portion at all size adjusted positions, whereby to provide increased strength and rigidity for said skate, enabling use of same in high performance applications;

said rear section being molded as a unitary piece and including a heel support and a longitudinally extending tongue portion, with said reinforcing member extending into said tongue portion; and said front section including a rearwardly facing opening for receiving said tongue-like portion in sliding relationship; and said reinforcing frame member being a U-channeled piece, the bottom flat portion of which is parallel to the support surface of said sole support piece and includes a plurality of openings spaced along the longitudinal axis of same; openings being molded into said tongue portion to align with the openings in said reinforcing member; and a pair of aligned openings provided on the upper and lower walls of said forward section which abound said tongue-receiving opening; and wherein said locking means comprises a threaded fastener and nut means; said fastener being passed through the opening of said reinforcing member and the aligned openings in said front and rear sections upon a selected interfitted position of said front and rear sections being achieved.

2. Apparatus in accordance with claim 1, further including front and rear strap means secured respectively to said front and rear sections for retaining the said skate in relation to the shoe and ankle of the user, upon said shoe being positioned upon said sole support piece.

3. Apparatus in accordance with claim 2, wherein said wheel assemblies include polyurethane wheels, and wherein said assemblies are joined to said front and rear sections through resilient shock mountings.

4. Apparatus in accordance with claim 1, wherein said front and rear sections comprise injection-molded polypropylene.

* * * * *